US010774827B2

(12) United States Patent
Lilie et al.

(10) Patent No.: US 10,774,827 B2
(45) Date of Patent: Sep. 15, 2020

(54) METHOD FOR ACTUATING SEMI-COMMANDED VALVE AND SYSTEM FOR ACTUATING SEMI-COMMANDED VALVE FOR MULTI-SUCTION ALTERNATIVE COMPRESSOR

(71) Applicant: Whirlpool S.A., São Paulo (BR)

(72) Inventors: Dietmar Erich Bernhard Lilie, Joinville (BR); Roberto Andrich, Joinville (BR)

(73) Assignee: Embraco Industria DE Compressores E Solucoes EM Refrigeracao LTDA., Joinville (BR)

( * ) Notice: Subject to any disclaimer, the term of this patent is extended or adjusted under 35 U.S.C. 154(b) by 1085 days.

(21) Appl. No.: 14/768,015

(22) PCT Filed: Jan. 31, 2014

(86) PCT No.: PCT/BR2014/000027
§ 371 (c)(1),
(2) Date: Aug. 14, 2015

(87) PCT Pub. No.: WO2014/124507
PCT Pub. Date: Aug. 21, 2014

(65) Prior Publication Data

US 2016/0003233 A1 Jan. 7, 2016

(30) Foreign Application Priority Data

Feb. 15, 2013 (BR) ..... 1020130035629

(51) Int. Cl.

| | |
|---|---|
| ***F04B 7/00*** | (2006.01) |
| ***F04B 35/04*** | (2006.01) |
| ***F04B 39/10*** | (2006.01) |
| ***F04B 49/06*** | (2006.01) |
| ***F04B 49/22*** | (2006.01) |
| ***F04B 39/08*** | (2006.01) |
| ***F04B 53/10*** | (2006.01) |

(52) U.S. Cl.
CPC ..... *F04B 49/06* (2013.01); *F04B 7/0076* (2013.01); *F04B 35/04* (2013.01); *F04B 39/08* (2013.01);
(Continued)

(58) Field of Classification Search
CPC ..... F04B 49/06; F04B 35/04; F04B 53/1082; F04B 7/0076; F04B 39/08; F04B 39/10;
(Continued)

(56) References Cited

U.S. PATENT DOCUMENTS 4,706,457 A * 11/1987 Tsunekawa ..... F02G 1/05 60/521
5,575,158 A * 11/1996 Vogel ..... F25B 47/022 62/156

(Continued)

FOREIGN PATENT DOCUMENTS

BR PI1105379 A2 11/2013
DE 102004018567 B3 12/2005

(Continued)

*Primary Examiner* — Essama Omgba
*Assistant Examiner* — Christopher J Brunjes
(74) *Attorney, Agent, or Firm* — Harrington & Smith

(57) ABSTRACT

A method for actuating a semi-commanded valve that acts in synchronism with the compression cycles of an alternative compressor, and a system for actuating a multi-suction alternative compressor semi-commanded valve. The method for actuating the semi-controlled valve may involve detecting at least one compression peak in the course of at least one mechanical cycle of the alternative compressor and switching the functional status of at least an alternative compressor semi-commanded valve based on detecting at least one compression peak in the course of at least one mechanical cycle of the alternative compressor.

2 Claims, 7 Drawing Sheets

(52) U.S. Cl.
CPC ..... *F04B 39/10* (2013.01); *F04B 49/225* (2013.01); *F04B 53/1082* (2013.01); *F04B 2201/1201* (2013.01); *F04B 2203/02* (2013.01); *F04B 2205/03* (2013.01)

(58) Field of Classification Search
CPC .. F04B 49/03; F04B 49/22; F04B 2203/0209; F04B 2205/03; F04B 49/225; F04B 2201/1201; F04B 2203/02; Y10T 137/0379; Y10T 137/0971
USPC .... 137/487.5; 417/280, 298, 302, 213, 44.1, 417/306, 297
See application file for complete search history.

(56) References Cited

U.S. PATENT DOCUMENTS

| | | | | |
|---|---|---|---|---|
| 5,722,818 | A | 3/1998 | Ohta et al. | 417/312 |
| 6,257,838 | B1 | 7/2001 | Schlossarczyk et al. | 417/280 |
| 6,408,832 | B1 * | 6/2002 | Christiansen | F02B 29/0418 123/311 |
| 2004/0094215 | A1 | 5/2004 | Dragoni et al. | 137/625.34 |
| 2004/0194466 | A1 | 10/2004 | Kawamura et al. | 60/612 |
| 2005/0000981 | A1 | 1/2005 | Peng et al. | 222/3 |
| 2007/0272178 | A1 | 11/2007 | Brun et al. | |
| 2011/0255994 | A1 * | 10/2011 | Field | F04B 49/022 417/53 |
| 2013/0255291 | A1 * | 10/2013 | Wu | F25B 7/00 62/115 |
| 2014/0182312 | A1 * | 7/2014 | Lundberg | F25B 45/00 62/56 |

FOREIGN PATENT DOCUMENTS

| | | | | |
|---|---|---|---|---|
| EP | 0851164 | A2 | 7/1998 | |
| EP | 1338794 | A1 * | 8/2003 | F04B 7/0076 |
| EP | 2581690 | A2 | 4/2013 | |
| GB | 2416196 | A | 1/2006 | |
| WO | 2009/129044 | A1 | 10/2009 | |
| WO | 2011/134030 | A2 | 11/2011 | |

* cited by examiner

METHOD FOR ACTUATING SEMI-COMMANDED VALVE AND SYSTEM FOR ACTUATING SEMI-COMMANDED VALVE FOR MULTI-SUCTION ALTERNATIVE COMPRESSOR

FIELD OF THE INVENTION

The present invention refers to a method for actuating semi-commanded valve acting in synchrony with compression cycles of an alternative compressor and, more particularly, to an alternative compressor provided with at least two suction inlets (and, consequently, two suction valves).

The present method mainly aims at optimizing the actuation moment and duration by energizing a magnetic field-generating element, of at least a semi-commanded valve, preferably a suction valve, pertaining to a double-suction alternative compressor.

The present invention further refers to a system for actuating a semi-commanded valve for multiple-suction alternative compressor and more particularly to an electronic system which, based on said method for actuating a semi-commanded valve, is capable of temporarily energizing at least one magnetic field-generating element responsible for switching the functional status of at least a suction valve pertaining to a double-suction alternative compressor.

BACKGROUND OF THE INVENTION

Conventional Alternative Compressors

As known by a person skilled in the art, alternative compressors comprise electro-mechanical devices capable of altering a working fluid pressure and are specifically used in refrigeration systems whose refrigeration fluid needs to be constantly pressurized.

In this sense, and more specifically speaking, alternative compressors are capable of altering the working fluid pressure by controllably altering the volume of a compression chamber that is usually defined by a cylindrical chamber able to receive working fluid and moving piston. Hence, compression chamber valve is alternatively altered (reduced or increased) in function of the moving piston displacement in its interior. Inlet and removal of working fluid are orderly managed by suction valves and discharge valves which have their statuses alternatively switched.

In conventional alternative compressors, an alternative movement of the moving piston from a rotary movement motor force and more specifically from an electric motor provided with a rotating shaft. In conventional embodiments, said rotary movement of the electric motor shaft is transformed into an alternative movement by means of a cooperative off-center into a linear rod, which is connected to the alternative piston.

This means that the rotary movement of the motor shaft is transformed into (back-and-forth) alternative movement imposed onto the alternative piston.

It is further noted that an electric motor mechanical cycle is transformed into an alternative piston compression cycle, that is, a complete rotation of the motor shaft (360°) is transformed into only one (back-and-forth) compression cycle of the alternative piston. Consequently, alternative piston displacement speed is proportional to the rotation speed of the electric motor shaft.

Conventional Alternative Compressor Valve Systems

With regard to valves constituting alternative compressors and, more specifically, in relation to the present method for actuating suction and/or discharge valves, it is known that the present state of the art essentially discloses three actuation methods, which are in one or another form related to valve assemblies.

It is known therefore that flexible valves (comprised of thin metal blades whose flexibility is defined in accordance with the working fluid) comprise a substantially automatic actuation method, where the (suction pressure and discharge pressure) working pressures themselves are capable of performing switching of the operational status of said valves.

Since switching of the operational status of said flexible valves is automatically performed there are no worries related to functioning synchronism thereof. Nevertheless, this type of valve does not permit to modulate the compression capacity of alternative compressors. In addition, the sizing of flexible valves (mainly the sizing of their widths) comprises high complexity factor, finally, alternative compressors of specific capacities require flexible valves of especially suitable sizes.

It is also known that semi-flexible valves (composed of metal blades whose flexibility is defined in accordance with a determined acting magnetic field) includes a semi-commanded actuation method, where a magnetic field generator responsible for generating pulses capable of performing the switching of said valves is used. An example of this kind of actuation method is found in BR Patent Application PI1105379-8, which refers to a semi-commanded valve system applied to alternative compressor comprising reed-type valves which once pre-stressed in a first operational status can be switched to a second operational status by actuating electric coils duly aligned with their respective valves.

In these cases, there are great concerns as to the moment at which the semi-flexible valves are actuated (operational status switching). This stems from the fact that advanced or retarded actuation may impair the compression capacity of alternative compressor. For example, the suction semi-flexible valve actuation during the period between the final of the suction cycle and beginning of the discharge cycle may require an oversized design of this valve for impact resistance since a valve closing acceleration force will be the sum of two forces: a force coming from the magnetic field of the actuation coil and the force coming from the beginning of the discharge cycle.

The present state of the art is already included in the synchronized methods for actuating commanded valves, where a semi-flexible discharge valve is closed at the moment a semi-flexible suction valve is opened, that is, switching of the operational status of opposed functionality valves occur in synchronism. However, the present state of the art does not comprise any method for actuating commanded valves where there is a synchronism between actuation of said valves and the compression cycles themselves. And there are no methods for actuating commanded valves whose actuation of the valves is synchronized with mechanical cycles of the compressor method.

The Concept of Multi-Suction Alternative Compressors

The PCT Application BR20011/000120 relates to two different concepts of multi-suction alternative compressors which in general terms show ability to act in refrigeration systems comprising at least two refrigeration lines of different pressures, wherein one refrigeration line is for the freezer and at least one line is for the cooler.

One of these concepts refers to an alternative compressor which is essentially conventional in its basic construction and presents the novelty of providing a single compressor cylinder with at least two suction inlets controlled by different suction valves (at least one of them being semi-commanded) of dynamically exclusive actuation, that is, while one of said suction valves is opened, the other suction valve is closed. This permits that a single compression cylinder of a single compressor can operate at different pressure levels, which, in this case, originates from different refrigeration lines, preferably from one same refrigeration system (one same refrigeration household appliance, for example).

One of said basis ideas behind this concept refers to the fact that the higher the switching frequency of the functional statuses of different suction valves the higher the impression that in fact there are multiple compressors when in fact only one exists. That is, a rapid alternation between the suction valves will produce an almost continuous suction of both refrigeration lines, even that a single refrigeration line is suctioned per shift.

To this effect, it is needed that the switching of each of the suction valves is precisely effected and preferably in synchronism with all the compressor mechanical cycles.

OBJECTS OF THE INVENTION

Relying on the concept outlined above the present invention was developed.

By this way, one of the objects of the present invention is to provide a method for actuating semi-commanded valve by at least an intrinsic parameter in the related functioning of alternative compressor, in one or another form, for the alternative compressor mechanical cycles.

In this sense, another primary object of the present invention is to provide a suction valve with synchronized actuation at the moment where the alternative piston compression peak in the course of the alternative compressor cycles occurs.

A further object of the present invention is to provide a method for actuating semi-commanded valve which is capable of optimizing the moment and duration of actuation of at least one alternative compressor semi-commanded valve.

Consequently, another object of the present invention is to provide a method for actuating valve, which will reduce the consumption of the semi-commanded valve actuation circuit by optimizing the duration of the actuation of at least one semi-commanded valve if this is commanded through electrical energization.

Finally, a still object of the present invention is to provide an actuation system which, based on the semi-commanded valve actuation method, can be implemented in multi-suction alternative compressors.

SUMMARY OF THE INVENTION

All the objects described above are obtained by means of a semi-commanded actuation valve and a system for actuating multi-suction alternative compressor semi-commanded valve, wherein both are primary objects of the present invention.

The method per se generally refers to a method capable of being implemented in alternative compressors and comprises at least one step of detecting at least a compression peak in the course of at least one alternative compressor mechanical cycle and one step of switching the functional status of at least one alternative-controlled semi-commanded valve based on the detection of at least one compression peak in the course of at least an alternative compressor mechanical cycle.

According to the present invention, the detection of at least one compression peak in the course of at least one alternative compressor mechanical cycle is carried out by measuring the peak of at least a parameter intrinsic in the functioning of said alternative compressor.

In this sense, said detection of at least one compression peak may be effected by measuring the peak of at least one electric parameter of said alternative compressor electric motor by measuring the peak of at least one mechanical parameter of said alternative compressor electric motor, or also by measuring the peak of at least one mechanical parameter of the compression mechanism of the alternative compressor.

It should be then mentioned that the electric parameter comprises the electric current of the alternative compressor, wherein the compression peak is equivalent to the electric current superior peak of the alternative compressor electric motor, or equivalent to at least one out-of-phase parameter in relation to the electric current superior peak of the alternative compressor electric motor. The mechanical parameter comprises a rotating shaft speed of the alternative compressor electric motor, where the compression peak is equivalent to the lower peak of the rotating shaft speed of the alternative compressor electric motor, or at least an out-of-phase parameter relative to the lower peak of the rotating shaft speed of the alternative compressor electric motor. The mechanical parameter of the compression mechanism of alternative compressor comprises the pressure inside the compression cylinder that constitutes the compression mechanism of the alternative compressor, the compression peak being quivalent to the superior peak of pressure inside the compressor cylinder that integrates the compression mechanism of the alternative compressor.

According to the present invention, it is also observed that the functional status switching of at least a semi-commanded valve and the detection of at least one compression peak in the course of at least one alternative compressor deactivation thereof occurs simultaneously, wherein said functional status switching of at least a semi-commanded vale comprises actuating or de-actuating same.

Preferably, the functional status switching of at least one semi-commanded valve is effected by electrical command and, more particularly, by energizing at least one magnetic field generator cooperating with its respective semi-commanded valve. Preferably it is also verified that the switching of the functional status of at least a semi-commanded valve provides non-energization of its respective magnetic field generator in at least one region around the compression peak, wherein said region can represent an advance gap or delay gap relative to the compression peak.

With regard to the actuation system for multi-function alternative compressor semi-commanded valve, and still in accordance with the present invention, it is verified that same comprises at least a semi-commanded valve capable of being electrically actuated by at least a magnetic field generator, at least a data processing core and at least a sensor, said data processing core being capable of receiving electric stimuli from the sensor and of generating electric stimuli for the magnetic field generator.

The multi-suction alternative compressor itself essentially comprises a compressor cylinder fluidly connected with at least two suction orifices and at least one discharge orifice;

each suction orifice being cooperative with a suction valve, wherein at least one of said suction valves comprises a semi-commanded valve.

Further it is noted that the system in accordance with the present invention stands out because the sensor comprises a sensor which is capable of measuring at least a parameter intrinsic in the functioning of said alternative compressor and the data processing core (a microcontroller or a microprocessor) comprises a data processing core capable of determining the parameter peak measured by the sensor. In addition, said data processing core comprises a data processing core capable of energizing the magnetic field generator based on the assessment of the parameter peak measured by the sensor.

Preferably, a semi-commanded valve comprises a reed-type metal valve. The magnetic field generator may in turn comprise an inductor or coil.

Still preferably, the sensor can comprise an amperemeter (available module pertaining to the data processing core), or a voltmeter (also available module pertaining to the data processing core) or a tachometer, or also a pressostat.

BRIEF DESCRIPTION OF THE DRAWINGS

The present invention is described in detail based on figures listed below, wherein.

DETAILED DESCRIPTION OF THE INVENTION

Figure 1A:
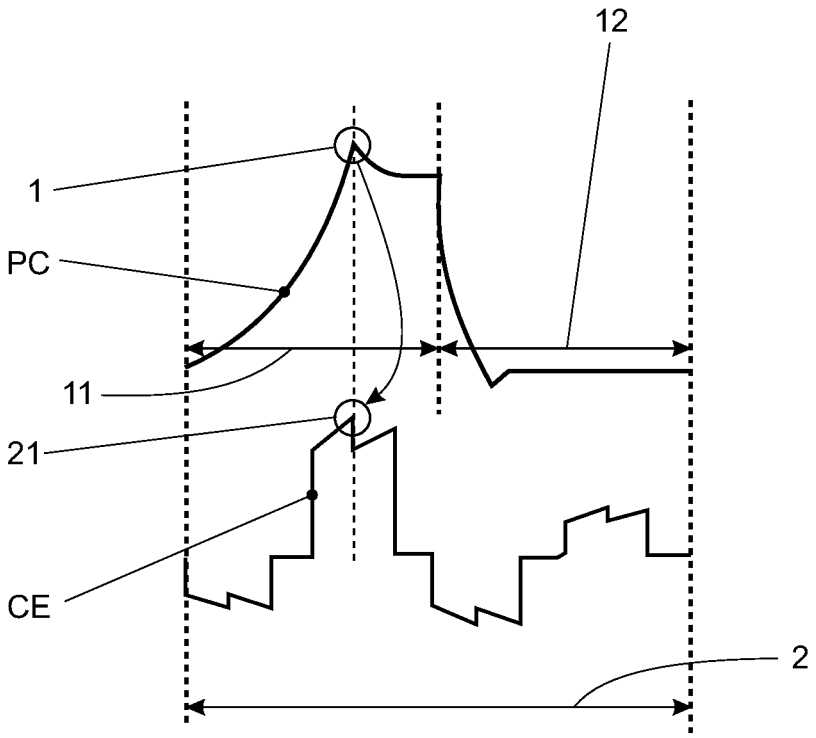
FIGS. 1A and 1B illustrate schematic graphs related to the detection of compression peak through electric current analysis of the compressor motor.

Before beginning the detailed description of the invention, it is necessary to define some of the following terms and expressions used.

The expression "semi-commanded valve" refers to any type of valve, either suction or discharge valve, which needs to be essentially associated with an actuation system or apparatus, that is, a non-automatic actuation valve. In other words, said valves are only actuated by a system or apparatus to be closed (or opened), wherein the opening (or closing) is performed automatically by the intrinsic forces of the fluid flow (when the compressor is operating) that acts against the valve body.

With regard to the present invention and in accordance with its preferred embodiment, reed-type valves made of metal blade are disclosed. Moreover, and still in accordance with the preferred embodiments of the present invention, said valves are actuated by a magnetic field generator, that is, a coil.

The expression "mechanical cycle" of the compressor refers to a compression cycle, concerning a back-and-forth movement of the alternative piston, which is displaced inside the compression cylinder. A compressor mechanical cycle is generally equivalent to a mechanical cycle or return of the electric motor contained in the compressor.

The expression "compression peak" refers to a maximum pressure that a working fluid (usually refrigeration fluid) is subjected within the compression cylinder. Generally speaking, the compression peak is reached some time before the opening of the discharge valve near the maximum positive displacement of the piston inside the compression cylinder. It should be pointed out that only one compression cycle per mechanical cycle occurs.

The expression "functional status switching" means a valve alteration position, that is, from the "closed" position to the "opened" position or from the "opened" position to the "closed" position".

Regarding the Controlled Valve Actuation Method Based on Compression Peak

In accordance with the present invention, the preferred controlled valve actuation method based on compression peak comprises two sequential steps.

The first step comprises detecting the compression peak in the course of the alternative compressor mechanical cycles.

The second step comprises switching the functional status of an alternative compressor valve based on the detection of at least a compression peak in the course of at least one alternative compressor mechanical cycle carried out in the first step.

More particularly, and in accordance with the present invention, detection of the compression peak in the course of the alternative compressor mechanical cycles is effected by measuring the peak of one of the parameters intrinsic in the functioning of said alternative compressor, wherein said intrinsic parameters of the functioning of the compressor are, for instance, the electric current of the compressor motor, the rotating shaft speed of the compressor motor or the compression cylinder pressure.

Regarding the Step of Detecting Compression Peaks

FIGS. 1A, 1B, 2A, 2B and 3 illustrate possibilities of detecting the compression cycle in accordance with the present invention.

Figure 1B:
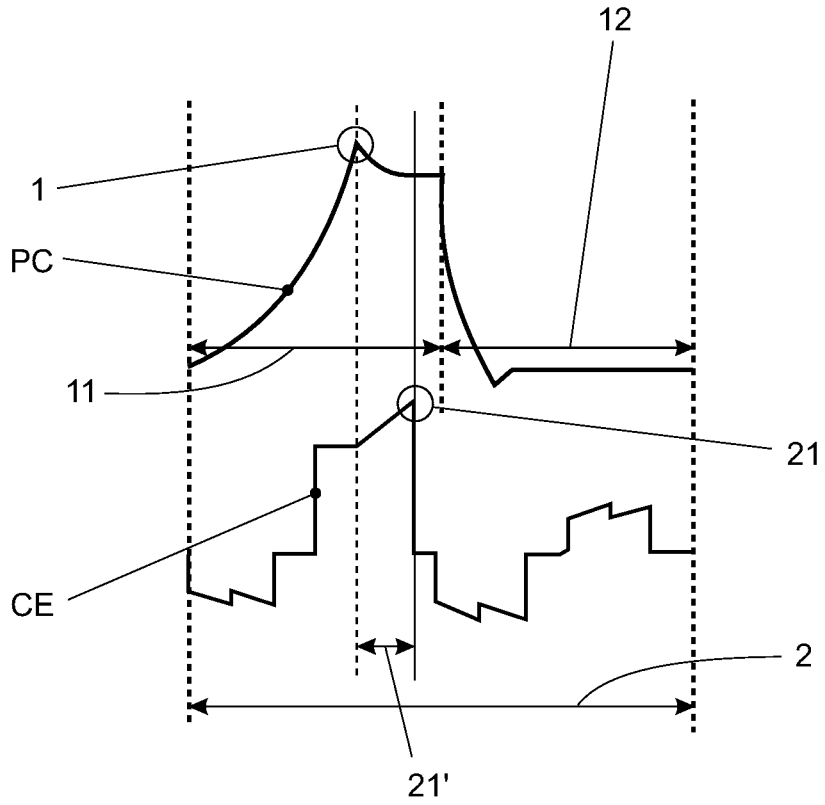

FIGS. 1A and 1B illustrate detection of the compression peak 1 (compression cylinder pressure PC) in a single mechanical cycle 2, by measuring the superior peak 21 (positive peak) of the electric current CE of the electric motor of the alternative compressor 5.

It should be pointed out the from the operation view point checked in real tests, compression peak does not occur at the superior neutral point but rather immediately before since the discharge valve opens prior to the superior neutral point, thereby equalizing the cylinder pressure to the condensation pressure.

From FIG. 1A it can be inferred that the compression peak 1 corresponds to the superior peak 21 of electric current CE and the compression peak 1 is valid because electric motor makes more effort (and consumes more electric current) when alternative piston reaches at high pressure its maximum positive displacement within the compression cylinder before the opening of the automatic flexible discharge valve, thus generating the highest compression pressure.

From FIG. 1B it can be inferred that the compression peak 1 may also correspond to an out-of-phase parameter 21' observed in relation to the superior peak 21 of electric current CE of the electric motor of the alternative compressor 5. This relationship, using an out-of-phase parameter 21', can be required (in practical applications) so as to more accurately determine a position at which compression peak occurs. Such an out-of-phase parameter may compensate, for example, for the delay effect on the variation of the electric current CE of the electric motor of the alternative compressor 5 when subjected to a compression force PC due to essentially inertial factors of electromechanical assemblies of said electric motor of the alternative compressor 5. Out-of-phase parameter 21' refers to a parameter preferably experimentally set.

Consequently, it is noted that each mechanical cycle 2 of said alternative compressor comprises only one compression peak 1, which occurs during the compression period 11 (complementary to the suction period 12).

It should be mentioned that measurement of the variation of electric current CE of the electric motor of said alternative compressor 5 can be conducted by methods and devices already known by a person skilled in the art.

Figure 2A:
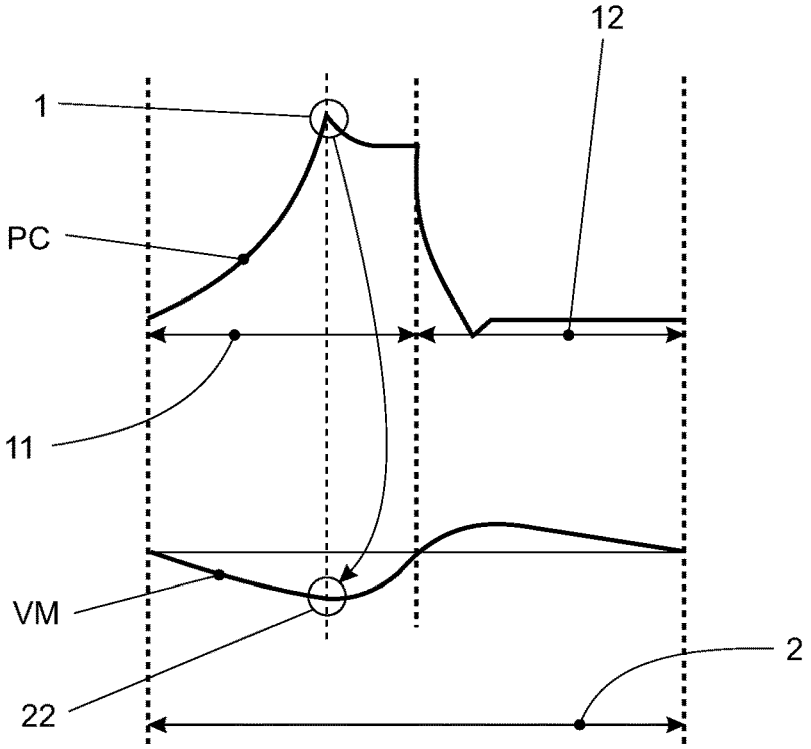
FIGS. 2A and 2B illustrate schematic graphs related to the detection of compression peak through analysis of the rotating shaft speed of the compressor motor.
Figure 2B:
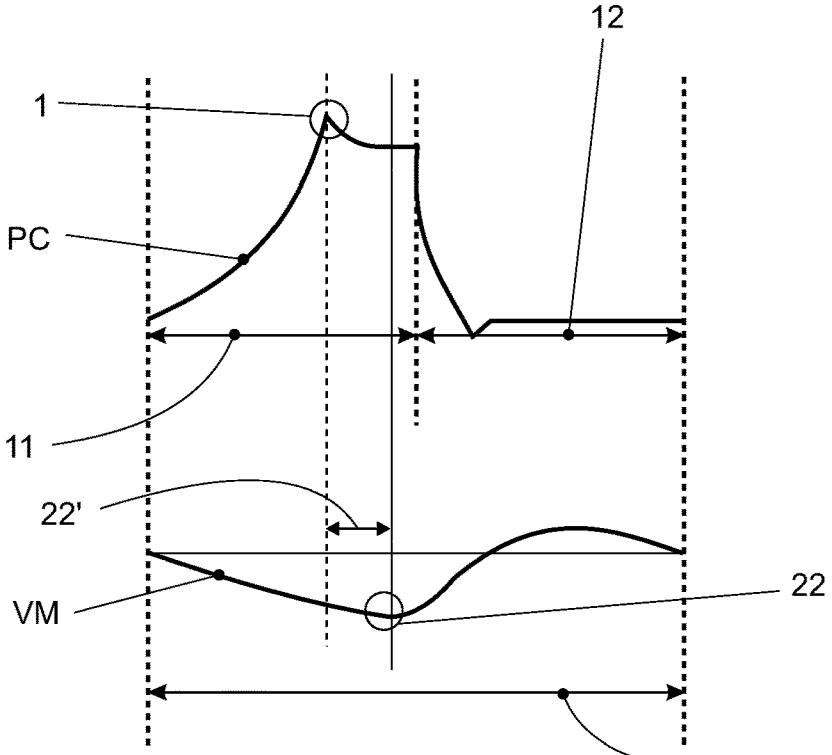

FIGS. 2A and 2B illustrate detection of compression peak 1 (of pressure PC of the compression cylinder), in a single mechanical cycle 2), by measuring lower peak 22 (negative peak) of speed VM of the electric motor of the alternative compressor 5.

From FIG. 2A it can be seen that compression peak 1 corresponds lower peak 22 of speed VM of the electric motor of the alternative compressor 5. Such relationship between lower peak 22 of speed VM and compression peak 1 is valid because the electric motor makes more effort (and presents a lower instantaneous speed) when the alternative piston reaches, at high pressure, its maximum positive displacement within the compression cylinder before the opening of the automatic flexible discharge valve and thus generating higher compression pressure.

From FIG. 2B it can be noted that compression peak 1 can also correspond to an out-of-phase parameter 22' observed in relation to lower peak 22 of speed VM of the electric motor of the alternative compressor 5. Such relationship, using an out-of-phase parameter 22', can be necessary (in practical applications) to determine with higher accuracy the position at which the compression peak occurs. This out-of-phase parameter may compensate, for example, for the delay effect on the variation of speed VM of the electric motor of the alternative compressor 5 when subjected to compression force PC due to essential inertial factors of electromechanical assemblies of said electric motor of the alternative compressor 5. The out-of-phase parameter 22' is a preferably experimentally set parameter.

Consequently, it is verified that each mechanical cycle 2 of said alternative compressor comprises at least a compression peak 1, which occurs during compression period 11 (complementary to the suction period 12).

It should be stressed out that measurement of the variation of speed VM of alternative compressor electric motor can be performed by methods and devices known by a person skilled in the art.

Figure 3:
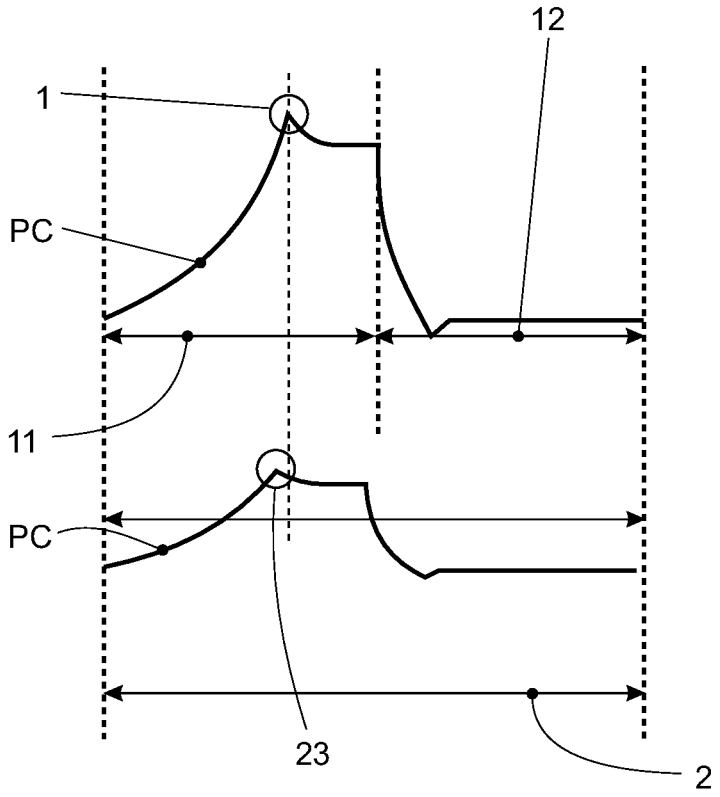
FIG. 3 illustrates a schematic graphic related to the detection of compression peak through analysis of the compression cylinder pressure.

FIG. 3 illustrates the detection of the compression peak 1 (of the compression cylinder pressure PC) in a single mechanical cycle 2 by directly measuring said compression cylinder pressure PC. From this figure, it can also be seen that the compression peak 1 corresponds to peak 23 of the compression cylinder pressure PC, Calculation of the variation of the compression cylinder pressure PC can be performed by methods and devices already known by a person skilled in the art.

Although this way of detecting said compression peak illustrated in FIG. 3 seems to be simpler than the ways of detecting compression peak illustrated in FIGS. 1A, 1D, 2A and 2B, it can be noted that installation of a pressure sensor (pressostat or the like) inside the compressor cylinder in order to measure the pressure PC refers to an "invasive" form of obtaining "data" and, consequently, it is not the most suitable form In parallel, the ways of detecting peak illustrated in FIGS. 1A, 1B, 2A and 2, because they comprise calculations of electric parameters, are "non-invasive forms" since different electric parameters of the motor are easily assessed.

Nevertheless, the step of detecting the compression peak can also be effected by not illustrated forms.

Regarding the Step of Switching the Functional Status of a Valve

As explained above, the method for actuating a controlled valve based on compression peak initially comprises compression peaks occurring through different types of "obtaining" data.

In this sense, the main merit of the present invention is to use detection of compression peaks to deliberately promote the switching of the operation status of one or more controlled valves (valves equivalent to those valves disclosed in BR PI1105379-8) in synchronism with the compression cycles of the alternative compressor 5.

Figure 4A:
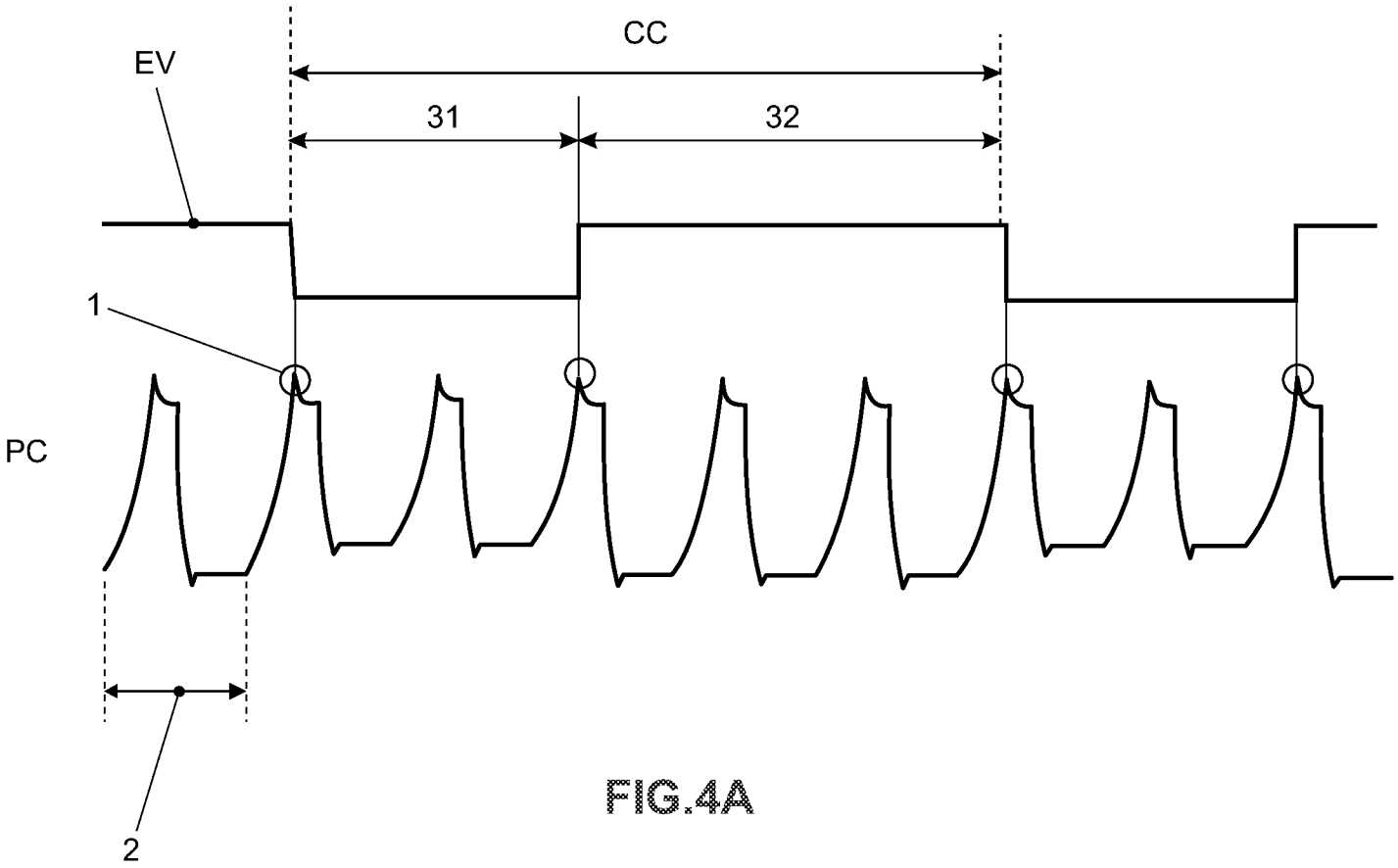
FIGS. 4A and 4B illustrate exemplary graphs related to actuation synchronism of a semi-commanded valve in accordance with the method of the present invention.
Figure 4B:
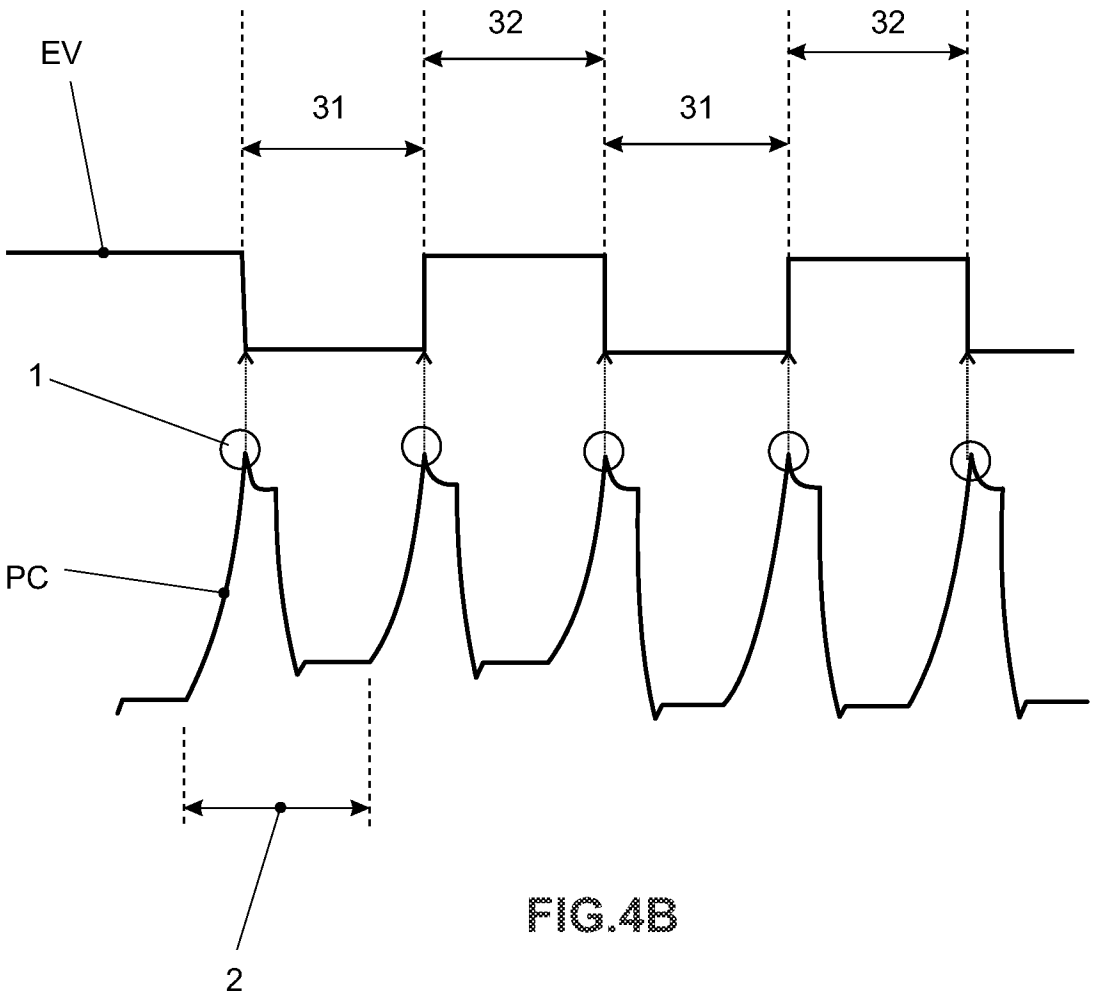

As illustrated in FIGS. 4A and 4B, the valve operation status (particular a suction valve) can be switched on the basis of the detection of at least one compression peak in the course of at least one alternative compression mechanical cycle.

Said figures show that said valve (not illustrated) assumes only one among two possible operational statuses EV: The operational status "opened" 31 and the operational status "closed" 32.

Therefore, and in accordance with the present invention, the switching of the operational statuses 31 and 32 takes place by using already known means (e.g. using an electromagnetic field generator as described in the document BR PI1105379-8) on the basis of detection of at least one compression peak in the course of at least one mechanical cycle 2 of the alternative compressor 5.

FIG. 4A illustrates a first possibility, as to say, of switching the valve operational statuses.

As can be noted, a first change in the operational status (from "closed" 32 to "opened" "31") is triggered by a detected compression peak 1. A second change in the operational status (from "opened" 31 to closed "32") is triggered by another compression peak 31 detected in mechanical cycles later.

In this case, switching of the operational statuses 31 and 32 does not occur in function of successive compression peaks 1 but rather in function of relevant compression peak 1 in accordance with predefined functional logics. Specifically in this case, a first switching between three compression peaks is performed and then a second switching is performed between three compression peaks. Consequently, the valve remains opened for a longer time, and such logics can be interesting for any system (e.g. a refrigeration system with its own specifications).

Therefore, and since the operational statuses 31 and 32 can be continuously kept in the course of multiple mechanical cycles 2, it is then possible to control—by means of the switching time of the operational statuses 31 and 32 of a (suction) valve—the capacity of an alternative compressor. In this example, the valve actuation element (not illustrated) is continuously kept energized/de-energized in the course of multiple mechanical cycles of the compressor.

From FIG. 4B it can be verified that switching between operational statuses 31 and 32 may occur in function of successive compression peaks 1, that is, valve operational status is switched at each detection of compression peak.

As the compression peaks 1 occurs in synchronous form, it can then be verified that, in this case, the switching between operational statuses 31 and 32 are also synchronous. To this effect, the valve actuation element (not illustrated) is energized/de-energized) in a pulse form at each mechanical cycle of the compressor motor.

The switching between operational statuses 31 and 32 of the semi-commanded valve preferably occurs by selective energization of a magnetic field generator (coil). In this situation and considering that said semi-commanded valve 3 comprises a metal reed-type suction valve, it is important to mention that selective energization of its respective magnetic field generator may not occur during all the period of said switching.

This stems from the fact that the valve tends to remain in a desirable operational status after a first selective energization of its respective magnetic field generator by the own compression "inertia."

Figure 5:
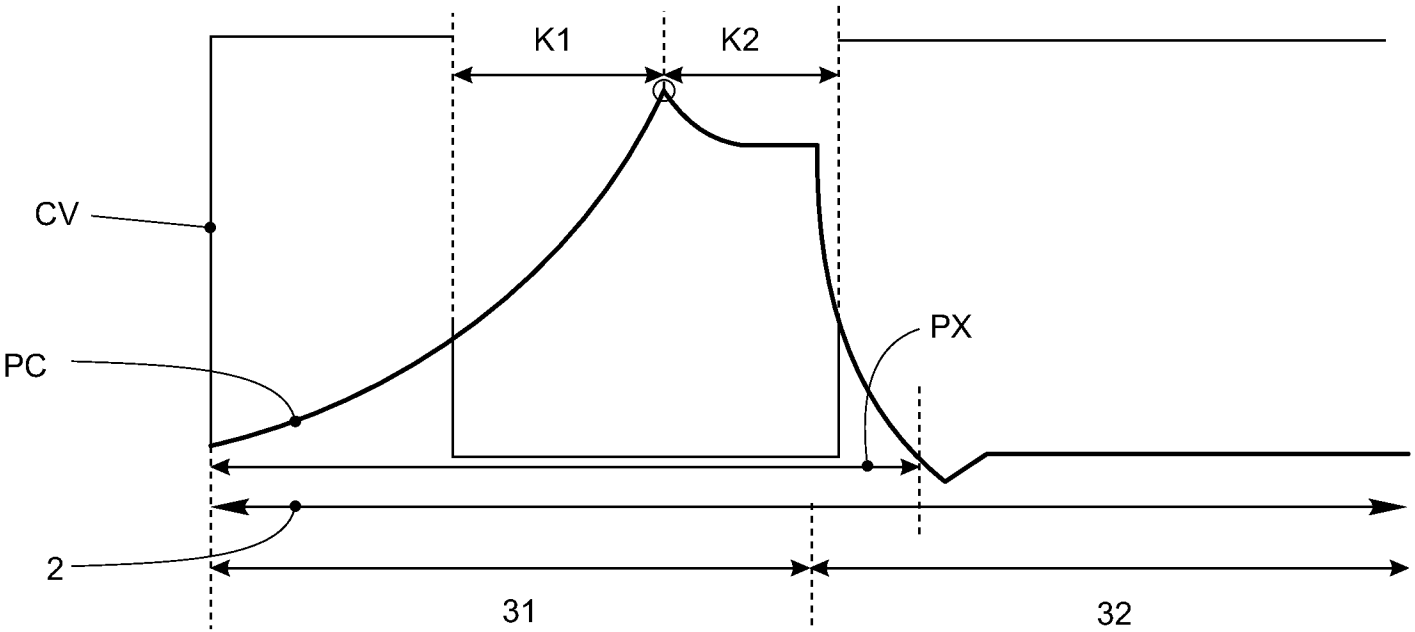
FIG. 5 illustrates an exemplary graph related to the energizing time responsible for actuation of a semi-commanded valve in accordance with the presently claimed method.

An exemplary graph is illustrated in FIG. 5, wherein the curve of pressure PC in the interior of the compression chamber of the compression is illustrated.

This figure shows a value PX related to the pressure to automatically maintain a desirable operational status (after a first selective energization of its respective magnetic field generator).

With regard to the pressure PC within the compression chamber same is higher than the value PX (which is usually related to the pressure in the suction line of the compressor), and considering the position of the compression peak 1, it is possible to define a region K1+K2 where the semi-commanded valve 3 tends to maintain (in function of the pressure differential) its desirable operational status.

Consequently, it is necessary to energize the respective magnetic field generator of the semi-commanded valve 3, with electric current CV, only in former and posterior regions to the region K1+kK. With this kind of actuation, power is saved during multiple switchings between the operational statuses 31 and 32 of the semi-commanded valve 3, The value of advance K1 and delay K2 are preferably experimentally obtained.

Figure 6:
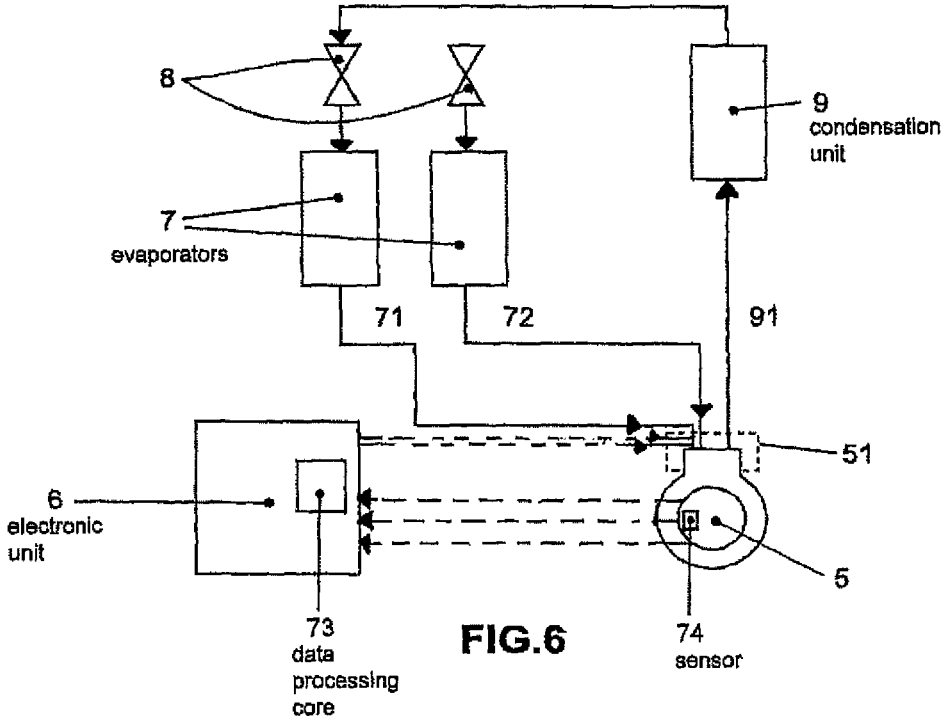
FIG. 6 illustrates a block diagram referring the preferred embodiment of application of the controlled valve actuation system in accordance with the present invention.
Figure 7:
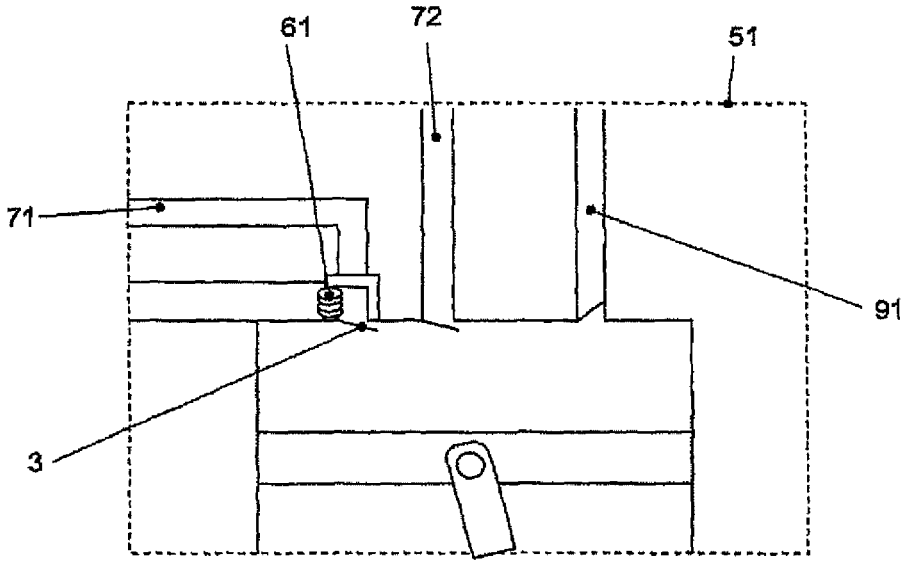
FIG. 7 conceptually illustrates the preferred embodiment of the controlled valve actuation system.

Regarding the System for Actuation of Semi-Commanded Valve for Multi-Suction Alternative Compressor FIGS. 6 and 7 schematically illustrate the implementation of the above-described method by a dedicated system in a multi-suction compressor and, more particularly, a multi-suction compressor as described in the first concept of PCT/BR2011/000120.

To this effect, FIG. 6 illustrates a refrigeration system suitable for implementation of this kind of double-suction compressor.

It is therefore illustrated an exemplary refrigeration system that operates suctioning refrigerant from two operation lines at different temperatures and pressures, which is constituted by a condensation unit 9 connected to discharge outlet 91 of the double-suction compressor 5 by two evaporator units wherein each one comprises an expansion element 8 and an evaporator 7, both connected to said double-suction compressor 7 by a low pressure suction line 72 and a high pressure suction line 71. The double-suction compressor 5 comprises at least one sensor 74 coupled to an electronic unit 6.

Furthermore, the system also comprises an electronic unit 6 for actuating the electric motor of the double-suction compressor 5 and at least a semi-commanded valve 3 disposed in the compressor. The electronic unit 6 comprises a data processing core 73 capable of receiving electric stimuli from the at least one sensor 74. In this example, the semi-commanded valve comprises one of the suction valves. Said semi-commanded valve 3 comprises one semi-commanded valve because it can be closed by injecting current into coil 61 and it can be exclusively opened via pressure difference between its suction line 71 and compression cylinder.

Furthermore, and as illustrated in FIG. 7 (which shows the interior of the compression cylinder), it is further provided another conventional non-controlled reed-type suction valve and a conventional, also not controlled, reed-type discharge valve.

Disclosed examples of the preferred embodiment of the present invention shall lead to the interpretation that the scope thereof contemplates other possible variations, which are only limited by the contents of claims, included therein the possible equivalent means.

The invention claimed is:

1. A method for actuating a semi-commanded valve for alternative compressors, the method comprising:

detecting at least one compression peak during at least one mechanical cycle of an alternative compressor; and switching a functional status of the semi-commanded valve based on the detection of the at least one compression peak, wherein the at least one compression peak is detected by measuring a positive peak of at least an electric current of an electric motor of the alternative compressor, wherein the at least one compression peak is based on the occurrence of a peak of at least one parameter which is out-of-phase relative to the at least one compression peak, wherein the peak of the at least one parameter is defined by the positive peak of the electric current of the electric motor of the alternative compressor.

2. A method for actuating a semi-commanded valve for alternative compressors, the method comprising:

detecting at least one compression peak during at least one mechanical cycle of an alternative compressor; and switching a functional status of the semi-commanded valve based on the detection of the at least one compression peak, wherein the at least one compression peak is detected by measuring a negative peak of at least a rotating shaft speed of an electric motor of the alternative compressor, wherein the at least one compression peak is based on the occurrence of a peak of at least one parameter which is out-of-phase relative to the at least one compression peak, wherein the peak of the at least one parameter is defined by the negative peak of the rotating shaft speed of the electric motor of the alternative compressor.

* * * * *